US011782380B1

(12) United States Patent
Hattori et al.

(10) Patent No.: US 11,782,380 B1
(45) Date of Patent: Oct. 10, 2023

(54) DOCUMENT READING DEVICE AND IMAGE FORMING APPARATUS

(71) Applicant: FUJIFILM Business Innovation Corp., Tokyo (JP)

(72) Inventors: Nobuyoshi Hattori, Kanagawa (JP); Tomonori Sato, Kanagawa (JP); Miho Morita, Kanagawa (JP); Tsuyoshi Mabara, Kanagawa (JP); Isamu Adachi, Kanagawa (JP); Tomomi Ishida, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/970,902

(22) Filed: Oct. 21, 2022

(30) Foreign Application Priority Data

Jun. 15, 2022 (JP) ..... 2022-096847

(51) Int. Cl.
*G03G 21/00* (2006.01)
*G03G 21/16* (2006.01)

(52) U.S. Cl.
CPC ..... *G03G 21/1633* (2013.01); *G03G 21/1638* (2013.01); *G03G 2215/0078* (2013.01)

(58) Field of Classification Search
CPC ..... G03G 21/1623; G03G 21/1633; G03G 21/1638; G03G 2215/0078
See application file for complete search history.

(56) References Cited

U.S. PATENT DOCUMENTS

2021/0250460 A1* 8/2021 Mabara ..... H04N 1/0066
2022/0194084 A1* 6/2022 Nakahata ..... B41J 29/38

FOREIGN PATENT DOCUMENTS

JP 2002-297001 A 10/2002

* cited by examiner

*Primary Examiner* — Hoang X Ngo
(74) *Attorney, Agent, or Firm* — Oliff PLC

(57) ABSTRACT

A document reading device includes: a device body; a transport path that is provided in the device body and through which a document is transported; a reading unit that is provided in the device body, has a reading surface, and reads an image of a document transported through the transport path; a moving part that is provided in the device body and is capable of being moved to a covering position at which the moving part covers the reading surface and to an exposing position at which the moving part exposes the reading surface; a first opening and closing part that is provided on the device body so as to be opened and closed and opens the transport path, at a first opening position; and a second opening and closing part that is provided beside the device body so as to be opened and closed or so as to be removable and mountable and exposes the moving part, at a second opening position or a removal position.

20 Claims, 8 Drawing Sheets

DOCUMENT READING DEVICE AND IMAGE FORMING APPARATUS

CROSS-REFERENCE TO RELATED APPLICATIONS

This application is based on and claims priority under 35 USC 119 from Japanese Patent Application No. 2022-096847 filed Jun. 15, 2022.

BACKGROUND

(i) Technical Field

The present disclosure relates to a document reading device and an image forming apparatus.

(ii) Related Art

Japanese Unexamined Patent Application Publication No. 2002-297001 discloses an image forming apparatus having an exterior covering part constituting a part of a housing and an opening and closing covering part mounted on the exterior covering part so as to be opened and closed. With the image forming apparatus, it is possible to maintain the inside of the housing by the exterior covering part being removed from the housing. The image forming apparatus includes: a fan that is held by the exterior covering part and sucks air outside the housing into the housing; a drive control unit that controls the drive of the fan; an opening and closing detection switch whose states are switched according to the opening and closing of the opening and closing cover; a notification unit that performs notification of the state of the opening and closing covering part whether open or closed based on the switched state of the opening and closing detection switch; a connector that electrically connects between the fan and the drive control unit and between the opening and closing detection switch and the notification unit and is pulled out when the exterior covering part is removed from the housing.

SUMMARY

It is conceivable to provide a document reading device including: a transport path that is provided in a device body and through which a document is transported; a reading unit that is provided in the device body and reads an image of a document transported through the transport path; a moving part that is provided in the device body and is capable of being moved to a covering position at which the moving part covers a reading surface of the reading unit and to an exposing position at which the moving part exposes the reading surface; and an opening and closing part that is provided on the device body so as to open, at an opening position, the transport path.

When a document jam is caused on a transport path, it is possible to unjam the document reading device by the opening and closing part being opened to open the transport path.

In the configuration, of the document reading device, in which the moving part is exposed only by the opening and closing part is opened, when the reading surface of the reading unit is cleaned, the opening and closing part is opened, and it is then required to move the moving part to the exposing position to clean the reading surface. Because there is no need to move the moving part in the document reading device when a document jam is caused, the opening and closing part may be closed with the moving part remaining at the exposing position, when the cleaning operation is confused with the operation for document jam during the cleaning of the reading surface.

Aspects of non-limiting embodiments of the present disclosure relate to suppressing an opening and closing part from being closed with a moving part remaining at an exposing position, compared with when the moving part is exposed only by the opening and closing part, which opens a transport path when at an opening position, being opened.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a document reading device including: a device body; a transport path that is provided in the device body and through which a document is transported; a reading unit that is provided in the device body, has a reading surface, and reads an image of a document transported through the transport path; a moving part that is provided in the device body and is capable of being moved to a covering position at which the moving part covers the reading surface and to an exposing position at which the moving part exposes the reading surface; a first opening and closing part that is provided on the device body so as to be opened and closed and opens the transport path, at a first opening position; and a second opening and closing part that is provided beside the device body so as to be opened and closed or so as to be removable and mountable and exposes the moving part, at a second opening position or a removal position.

BRIEF DESCRIPTION OF THE DRAWINGS

An Exemplary embodiment of the present disclosure will be described in detail based on the following figures, wherein.

DETAILED DESCRIPTION

Hereinafter, one exemplary embodiment according to the present disclosure will be described based on the figures.

(Image Forming Apparatus 10)

Figure 1:
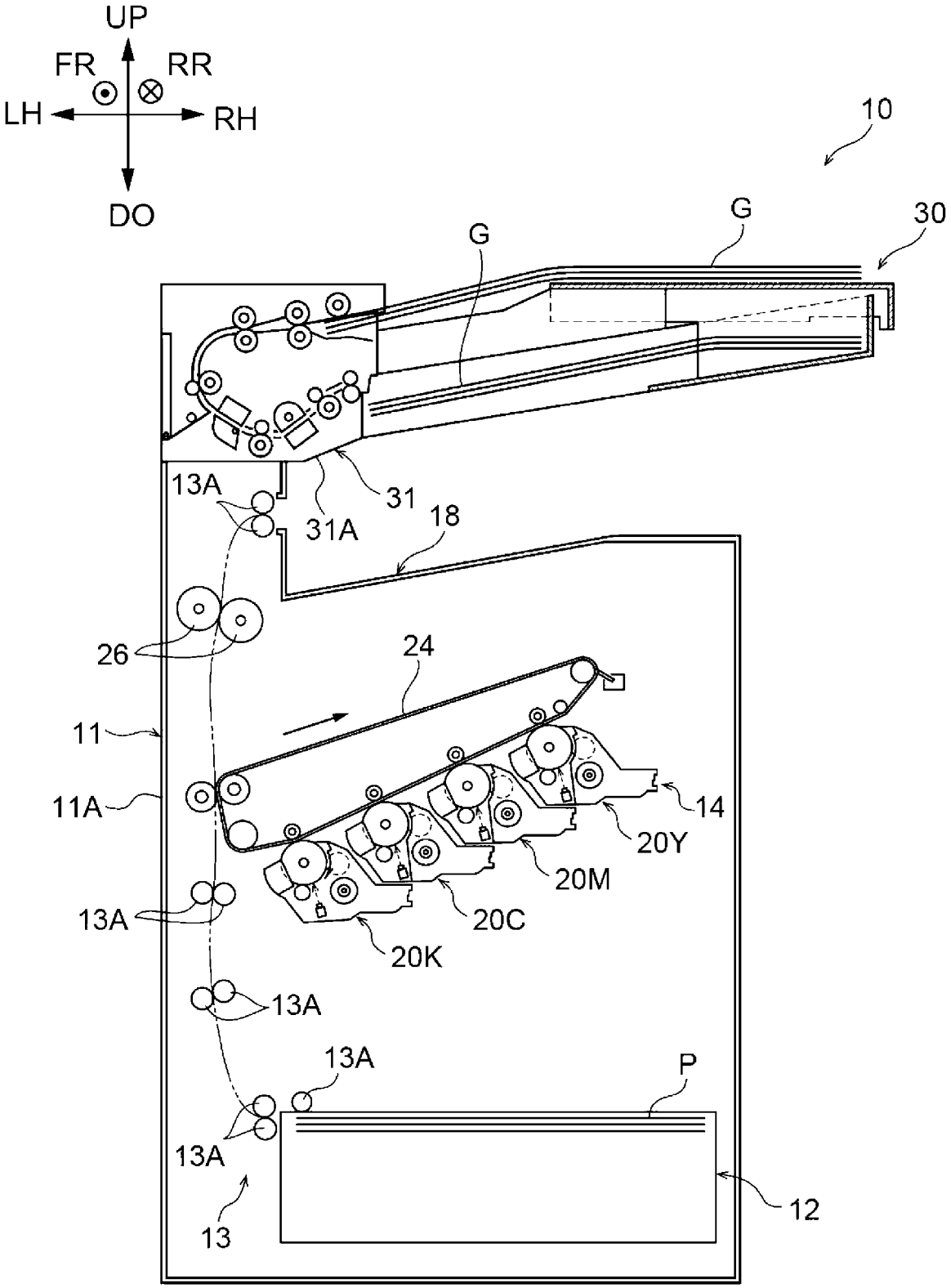
FIG. 1 is a schematic view of an image forming apparatus according to the present exemplary embodiment.

The configuration of an image forming apparatus 10 according to the present exemplary embodiment will be described. FIG. 1 is a schematic view of the configuration of the image forming apparatus 10 according to the present exemplary embodiment.

Note that, in the figures, arrow UP indicates the upper side of the apparatus (specifically, the upper side in the vertical direction), and arrow DO indicates the lower side of the apparatus (specifically, the lower side in the vertical direction). In the figures, arrow LH indicates the left side of the apparatus, and arrow RH indicates the right side of the apparatus. In the figures, arrow FR indicates the front side of the apparatus, and arrow RR indicates the rear side of the apparatus. The above-described directions are defined for convenience of description and thus does not limit the apparatus configuration. Note that, when each of the directions regarding the apparatus is used, the term "apparatus" is sometimes omitted. For example, the "upper side of the apparatus" is sometimes simply given as the "upper side".

In addition, in the following description, the "up-and-down direction" is used as "both directions toward the upper side and the lower side" or "one of the directions toward the upper side and the lower side". The "right-and-left direction" is used as "both directions toward the right side and the left side" or "one of the directions toward the right side and the left side". Note that the "right-and-left direction" may alternatively be expressed by terms such as beside, the lateral direction, and the horizontal direction. The "front-and-rear direction" is used as "both directions toward the front side and the rear side" or "one of the directions toward the front side and the rear side". Note that the "front-and-rear direction" may alternatively be expressed by terms such as beside, the lateral direction, and the horizontal direction. Moreover, the up-and-down direction, the right-and-left direction, and the front-and-rear direction intersect one another (specifically, orthogonal to one another).

In the figures, a symbol of an encircled cross represents an arrow directed from the near side toward the far side of the plane of the paper sheet of each figure. In the figures, a symbol of an encircled solid filled circle represents an arrow directed from the far side toward the near side of the plane of the paper sheet of each figure.

The image forming apparatus 10 in FIG. 1 forms an image. Specifically, as FIG. 1 illustrates, the image forming apparatus 10 has an image forming apparatus body 11, a medium storage unit 12, a medium discharge part 18, a transport unit 13, an image forming section 14, and a document reading device 30. Hereinafter, each of the elements of the image forming apparatus 10 will be described.

(Image Forming Apparatus Body 11)

The image forming apparatus body 11 in FIG. 1 includes the image forming section 14. Specifically, the image forming apparatus body 11 is provided with each of the constituting elements of the image forming apparatus 10 including the image forming section 14 and has a housing 11A in which the constituting elements of the image forming apparatus 10 are accommodated.

In the present exemplary embodiment, the medium storage unit 12, the transport unit 13, and the image forming section 14 are disposed inside the image forming apparatus body 11 (specifically, the housing 11A). In addition, the medium discharge part 18 and the document reading device 30 are disposed on the upper side relative to the image forming apparatus body 11 (specifically, the housing 11A).

(Medium Storage Unit 12)

In the image forming apparatus 10, the medium storage unit 12 in FIG. 1 stores a recording medium P. The recording medium P stored in the medium storage unit 12 is transported to the image forming section 14. The recording medium P to be stored in the medium storage unit 12 is a subject on which an image is formed by the image forming section 14. Examples of the recording medium P include a paper sheet and a film. Examples of such a film include a resin film and a metal film. Note that the recording medium P is not limited to the above-described materials, and various types of recording mediums may be used.

(Medium Discharge Part 18)

The medium discharge part 18 in FIG. 1 is a part onto which the recording medium P having an image formed by the image forming section 14 is discharged. The medium discharge part 18 is positioned in an upper region of the image forming apparatus body 11 (the housing 11A) and on the lower side relative to the document reading device 30. Specifically, the medium discharge part 18 is constituted by an upper surface of the housing 11A.

(Transport Unit 13)

In the image forming apparatus 10, the transport unit 13 in FIG. 1 transports a recording medium P. Specifically, the transport unit 13 transports the recording medium P stored in the medium storage unit 12 to the medium discharge part 18. In the present exemplary embodiment, as FIG. 1 illustrates, the transport unit 13 has transport members 13A including plural transport rollers or other members and transports the recording medium P by using the transport members 13A. Note that, examples of the transport member 13A may include a transport belt and a transport drum, and various transport members may be used.

(Image Forming Section 14)

The image forming section 14 in FIG. 1 is capable of forming the image that has been read by the document reading device 30, on a recording medium. Specifically, the image forming section 14 forms, by an electrophotographic system, a toner image (an example of an image) on the recording medium P transported by the transport unit 13 (specifically, the transport members 13A). More specifically, as FIG. 1 illustrates, the image forming section 14 is provided with toner image forming units 20Y, 20M, 20C, and 20K (hereinafter, referred to as 20Y to 20K), a transfer body 24, and a fixing part 26.

In the image forming section 14, the toner image forming units 20Y to 20K perform charging, exposure, development, and transfer processes to form toner images of the colors: yellow (Y), magenta (M), cyan (C), and black (K) on the transfer body 24. Moreover, the image forming section 14 transfers the toner images of the four colors that have been formed on the transfer body 24, onto the recording medium P and fixes the toner images to the recording medium P at the fixing part 26. As described above, the image forming section 14 employs an intermediate transfer system by which an image is transferred onto a recording medium P by using the transfer body 24.

Note that an example of the image forming section is not limited to the above-described image forming section 14. For such an example of the image forming section, there may be employed a direct transfer system by which the toner image forming units 20Y to 20K form toner images directly on a recording medium P without the transfer body 24. Another example of the image forming section may be an image forming section that forms an image while ejecting ink onto a recording medium P. That is, any image forming section having a function of forming an image on a recording medium P may be used.

(Document Reading Device 30)

Figure 2:
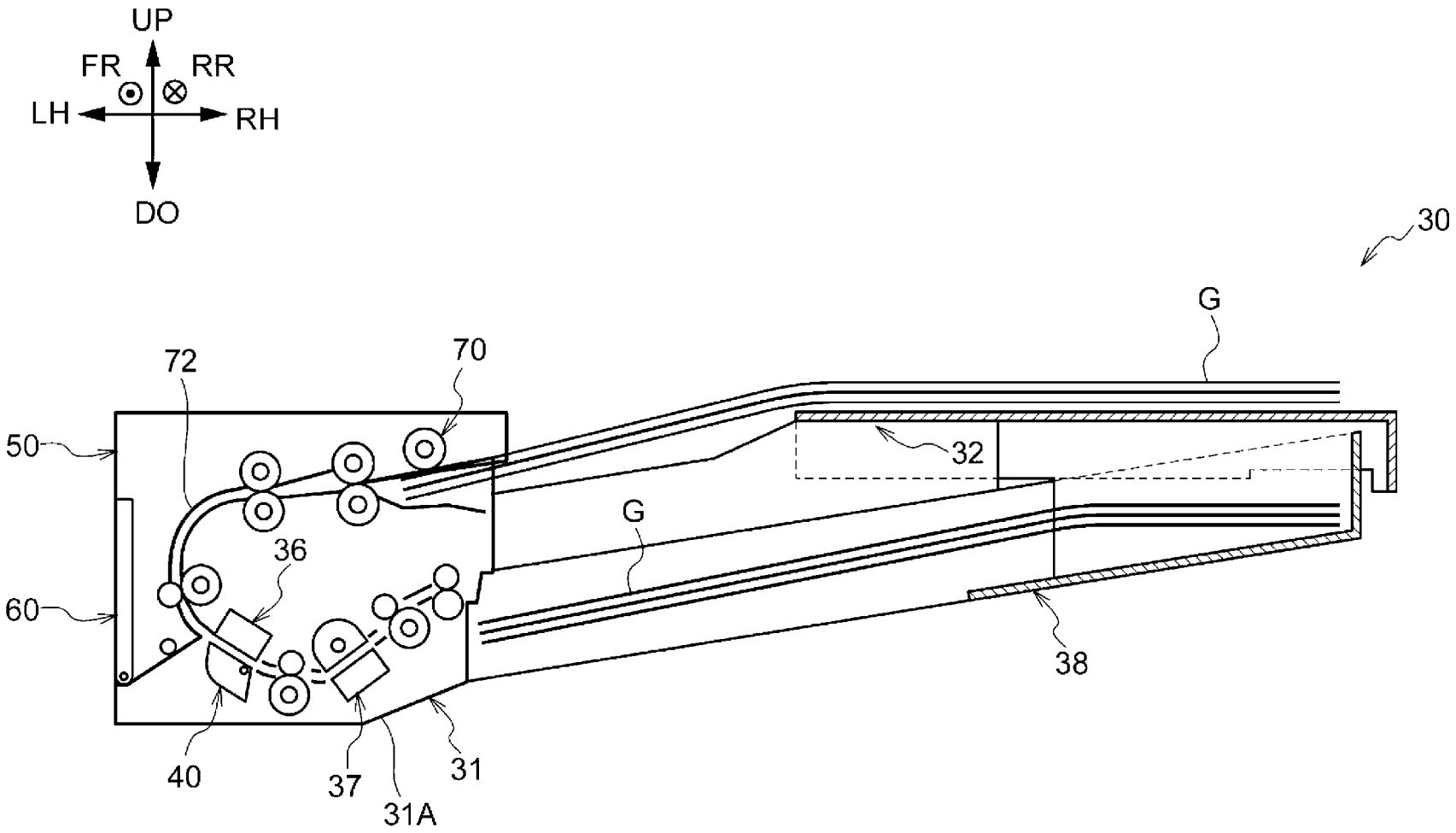
FIG. 2 is a schematic view of a document reading device according to the present exemplary embodiment.

The document reading device 30 in FIG. 1 reads an image of a document G. Specifically, as FIG. 2 illustrates, the document reading device 30 has a document reading device body 31, a document storage part 32, a document discharge part 38, a transport mechanism 70, reading units 36 and 37, a reading unit covering part 40, a first opening and closing covering part 50, and a second opening and closing covering part 60. Hereinafter, each of the elements of the document reading device 30 will be described.

(Document Reading Device Body 31)

Figure 3:
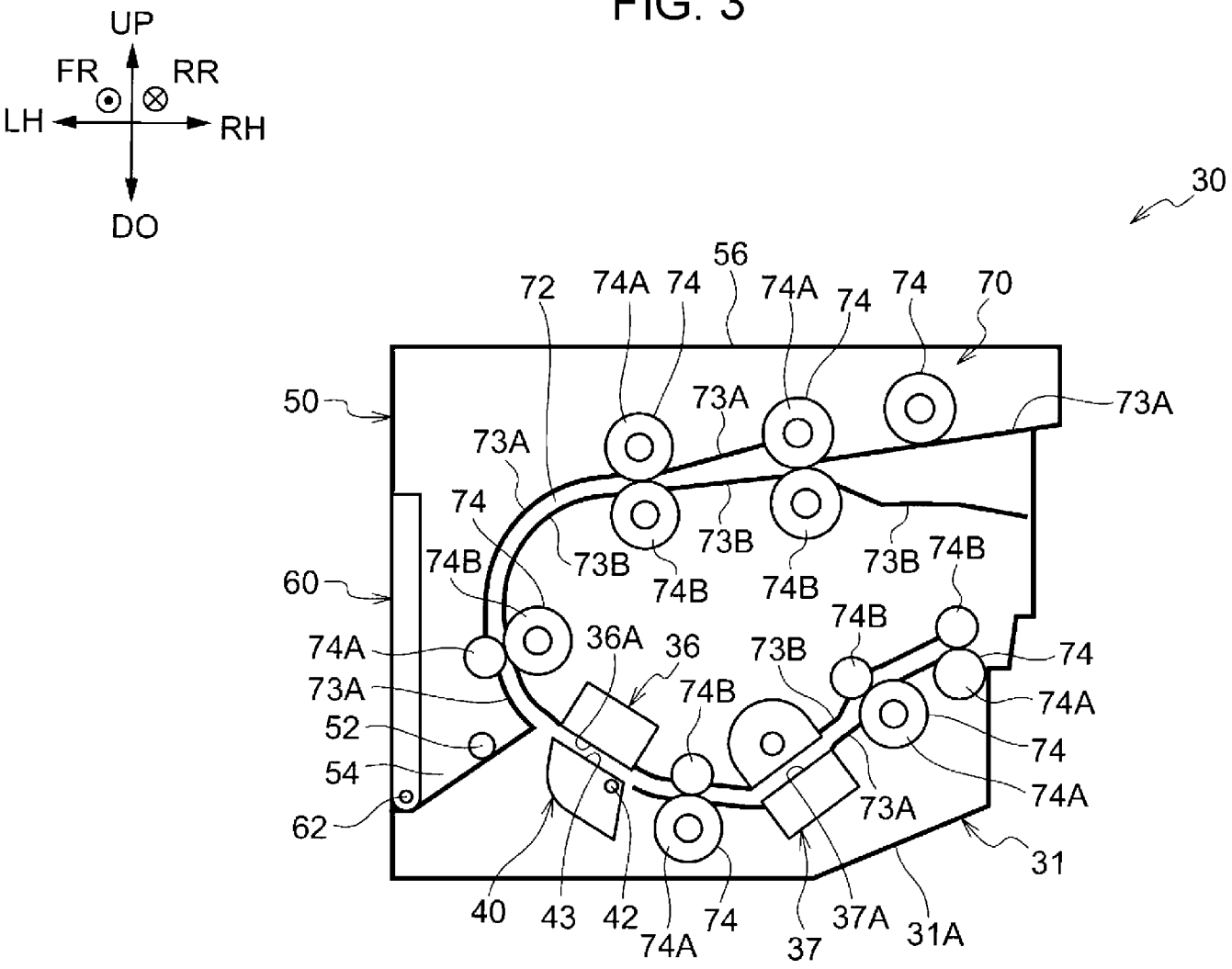
FIG. 3 is a schematic partial view of the document reading device according to the present exemplary embodiment.

The document reading device body 31 in FIG. 2 and FIG. 3 is an example of a device body. The document reading device body 31 is provided with each of the constituting elements of the document reading device 30 and has a housing 31A in which the constituting elements of the document reading device 30 are accommodated.

As FIG. 1 illustrates, the document reading device body 31 is disposed on the upper side relative to and fixed relative to the image forming apparatus body 11. Specifically, on the left side relative to the medium discharge part 18, a lower end portion of the document reading device body 31 is fixed to an upper end portion of the image forming apparatus body 11. That is, the document reading device body 31 does not perform a relative movement such as rotation relative to the image forming apparatus body 11.

In the present exemplary embodiment, as FIG. 2 and FIG. 3 illustrate, the transport mechanism 70, the reading units 36 and 37, and the reading unit covering part 40 are disposed inside the document reading device body 31 (specifically, the housing 31A). As FIG. 2 illustrates, the document storage part 32 and the document discharge part 38 are disposed on the right side relative to the document reading device body 31 (specifically, the housing 31A). In addition, the first opening and closing covering part 50 is disposed on the left side and on the upper side relative to the document reading device body 31 (specifically, the housing 31A). The second opening and closing covering part 60 is also disposed on the left side relative to the document reading device body 31 (specifically, the housing 31A). That is, the second opening and closing covering part 60 is disposed on the side opposite to the document storage part 32 and the document discharge part 38, with the document reading device body 31 (specifically, the housing 31A) therebetween.

(Document Storage Part 32)

In the document reading device 30, the document storage part 32 in FIG. 2 stores a document G. As FIG. 2 illustrates, the document storage part 32 extends diagonally to the upper right side from the document reading device body 31 and stores a document G by holding the document G thereon. The document G stored on the document storage part 32 is transported to the reading units 36 and 37. The document G to be stored on the document storage part 32 is a subject to be read by the reading units 36 and 37. Examples of the document G include a paper sheet and a film. Examples of such a film include a resin film and a metal film. Note that the document G is not limited to the above-described materials, various types of documents may be used.

(Document Discharge Part 38)

The document discharge part 38 in FIG. 2 is a part onto which the document G whose image has been read by the reading units 36 and 37 is discharged. As FIG. 2 illustrates, the document discharge part 38 on the lower side relative to the document storage part 32 extends diagonally to the upper right side from the document reading device body 31 and stores the document G that has been discharged from the document reading device body 31, by holding the document G thereon.

(Transport Mechanism 70)

In the document reading device 30, the transport mechanism 70 in FIG. 2 and FIG. 3 transports a document G. Specifically, as FIG. 3 illustrates, the transport mechanism 70 is provided in the document reading device body 31 and has a document transport path 72 and plural transport members 74.

The document transport path 72 that is an example of a transport path is a transport path through which a document G is transported. As FIG. 2 illustrates, the document transport path 72 extends from the document storage part 32 toward the document discharge part 38 to have a C shape when viewed in the front-and-rear direction. Such a situation of being viewed in the front-and-rear direction is the situation of being viewed from one side of the front and the rear toward the other side.

As FIG. 3 illustrates, specifically, the document transport path 72 is constituted by transport path surfaces 73A and 73B that face one another and are provided in the document reading device body 31.

Each of the transport members 74 is constituted by a pair of transport rollers 74A and 74B and transports the document G stored on the document storage part 32, along the document transport path 72, to the document discharge part 38. Note that, examples of the transport member 74 may include a transport belt and transport drum, and various transport members may be used.

(Reading Units 36 and 37)

Each of the reading units 36 and 37 in FIG. 2 and FIG. 3 is provided in the document reading device body 31 and reads an image of the document G transported through the document transport path 72.

As FIG. 3 illustrates, the reading unit 36 is positioned in the middle of the document transport path 72 and on the inner circumferential side of the C-shaped document transport path 72. The reading unit 36 has a reading surface 36A through which an image is read. The reading surface 36A faces one side of the document G transported through the document transport path 72, and, through the reading surface 36A, the reading unit 36 reads an image of the one side of the document G transported through the document transport path 72. Note that the reading surface 36A also functions as a guide surface (that is, a transport path surface) for guiding the document G.

As FIG. 3 illustrates, the reading unit 37 is positioned, in the document transport path 72, downstream of the reading unit 36 in the transport direction and positioned on the outer circumferential side of the C-shaped document transport path 72. The reading unit 37 has a reading surface 37A through which an image is read. The reading surface 37A faces the other side of the document G transported through the document transport path 72, and, through the reading surface 37A, the reading unit 37 reads an image of the other side of the document G transported through the document transport path 72. Note that the reading surface 37A also functions as a guide surface (that is, a transport path surface) for guiding the document G.

An example of each of the reading units 36 and 37 is a close contact-type image sensor called a Contact Image Sensor (CIS). Note that each of the reading units 36 and 37 is not limited to such a close contact-type image sensor, may be another type of image sensor, and may be any constituting element being capable of reading an image of a document G.

(Reading Unit Covering Part 40)

The reading unit covering part 40 in FIG. 2 and FIG. 3 is an example of a moving part and is provided in the document reading device body 31. Specifically, as FIG. 3 illustrates, the reading unit covering part 40 is at a position so as to face the reading surface 36A of the reading unit 36 (specifically, at a position on the lower side relative to the reading unit 36).

Figure 6:
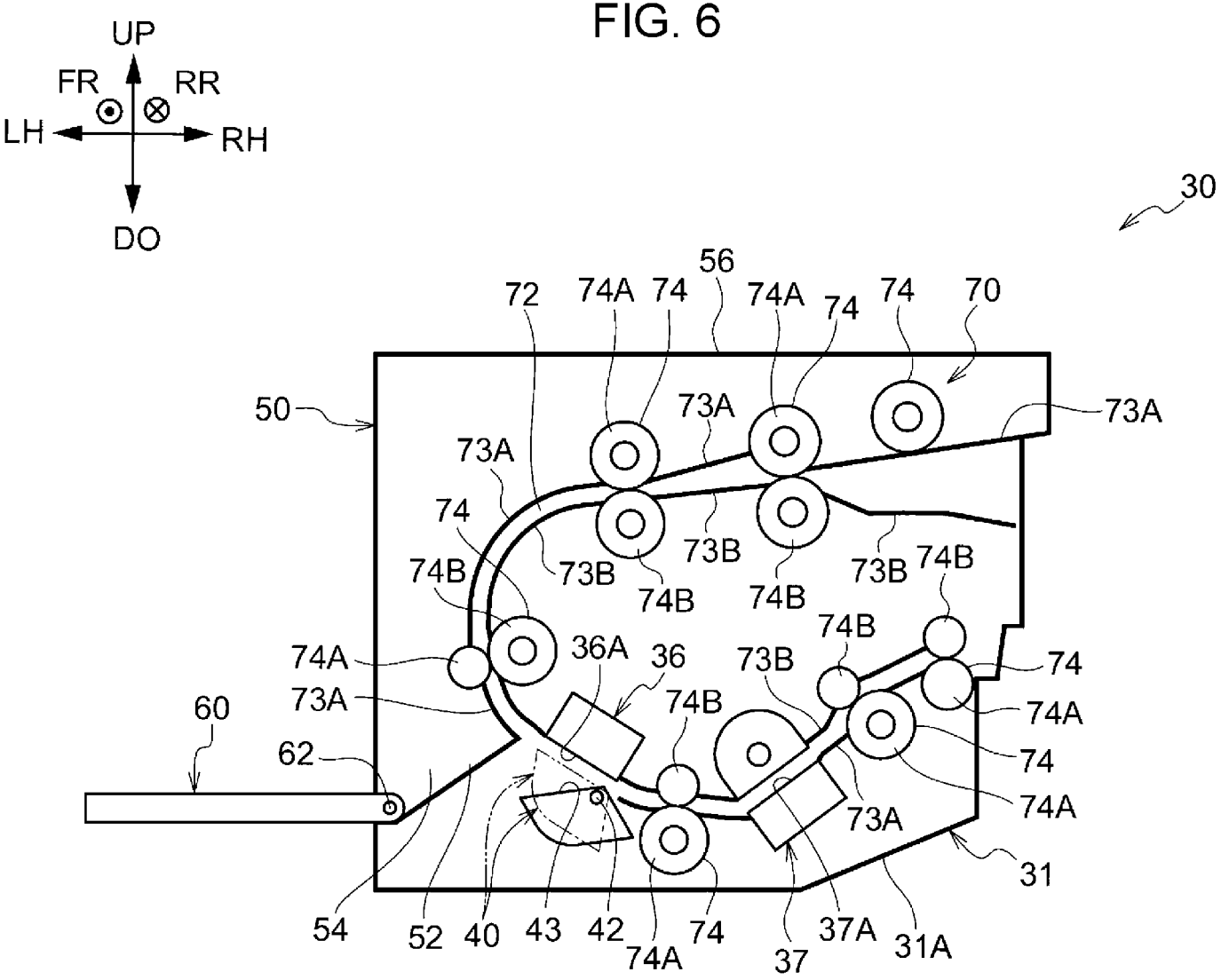
FIG. 6 is a schematic view of the document reading device in FIG. 5 with a reading unit covering part being open.

The reading unit covering part 40 is capable of being moved to a covering position at which the reading unit covering part 40 covers the reading surface 36A of the reading unit 36 (the position represented by the chain double-dashed line in FIG. 6) and to an exposing position at which the reading unit covering part 40 exposes the reading surface 36A of the reading unit 36 (the position represented by the solid line in FIG. 6).

Specifically, the reading unit covering part 40 has a rotating shaft 42 at a position downstream in the transport direction (specifically, on the right side) and on the reading surface 36A side (specifically, on the upper side). By being rotated around the rotating shaft 42, the reading unit covering part 40 is moved between the covering position (represented by the chain double-dashed line in FIG. 6) and the exposing position (represented by the solid line in FIG. 6).

The reading unit covering part 40 has a facing surface 43 that faces the reading surface 36A of the reading unit 36 when the reading unit covering part 40 is at the covering position. With the reading unit covering part 40 being at the covering position, the facing surface 43 serves as a guide surface (that is, a transport path surface) for guiding the document G while facing the other side of the document G. That is, the facing surface 43, with the reading surface 36A, forms a transport path. In this way, the reading unit covering part 40, when being at the covering position, functions as a guide part that guides a document G.

(First Opening and Closing Covering Part 50)

The first opening and closing covering part 50 in FIG. 2 and FIG. 3 is an example of a first opening and closing part. The first opening and closing covering part 50 is provided on the document reading device body 31 so as to be opened and closed and, when at an opening position, opens the document transport path 72.

As FIG. 3 illustrates, the first opening and closing covering part 50 has a covering part body 54 disposed beside (specifically, on the left side relative to) the document reading device body 31 and has an upper part 56 disposed on the upper side relative to the document reading device body 31.

As FIG. 3 illustrates, the covering part body 54 is provided, while extending in the up-and-down direction, beside (specifically, on the left side relative to) the document reading device body 31. Specifically, the covering part body 54 beside (specifically, on the left side relative to) the document reading device body 31 extends from a lower part to an upper part of the document reading device body 31. Moreover, the covering part body 54 constitutes a side part of the document reading device 30, and a side surface of the covering part body 54 (specifically, the left side surface) constitutes a side surface (specifically, the left side surface) of the document reading device 30. In the present exemplary embodiment, the covering part body 54 is disposed beside (specifically, on the left side relative to) the reading unit 36 and the reading unit covering part 40.

As FIG. 3 illustrates, the upper part 56 is provided, while extending in the right-and-left direction, on the upper side relative to the document reading device body 31. Specifically, the upper part 56 positioned on the upper side relative to the document reading device body 31 extends rightward from an upper part of the covering part body 54. The upper part 56 constitutes an upper part of the document reading device 30, and an upper surface of the upper part 56 constitutes an upper surface of the document reading device 30. Due to such an arrangement of the upper part 56 and the covering part body 54, the first opening and closing covering part 50 has an L shape when viewed in the front-and-rear direction.

Moreover, the first opening and closing covering part 50 has a rotating shaft 52 provided in a lower part and is supported by the document reading device body 31 so as to be opened and closed around the rotating shaft 52. Specifically, the rotating shaft 52 is provided, in the covering part body 54, in a part on the lower side and on the reading unit covering part 40 side (specifically, on the right side).

The first opening and closing covering part 50 is opened and closed between an opening position (given in FIG. 4) and a closing position (given in FIG. 3) by the upper part thereof being rotated about the rotating shaft 52. Specifically, the first opening and closing covering part 50 is rotated from the closing position to the opening position by being inclined leftward, from the closing position, at approximately 90 degrees. Note that the opening position is a position at which the first opening and closing covering part 50 is opened relative to the document reading device body 31, and the closing position is a position at which the first opening and closing covering part 50 is closed relative to the document reading device body 31.

Figure 4:
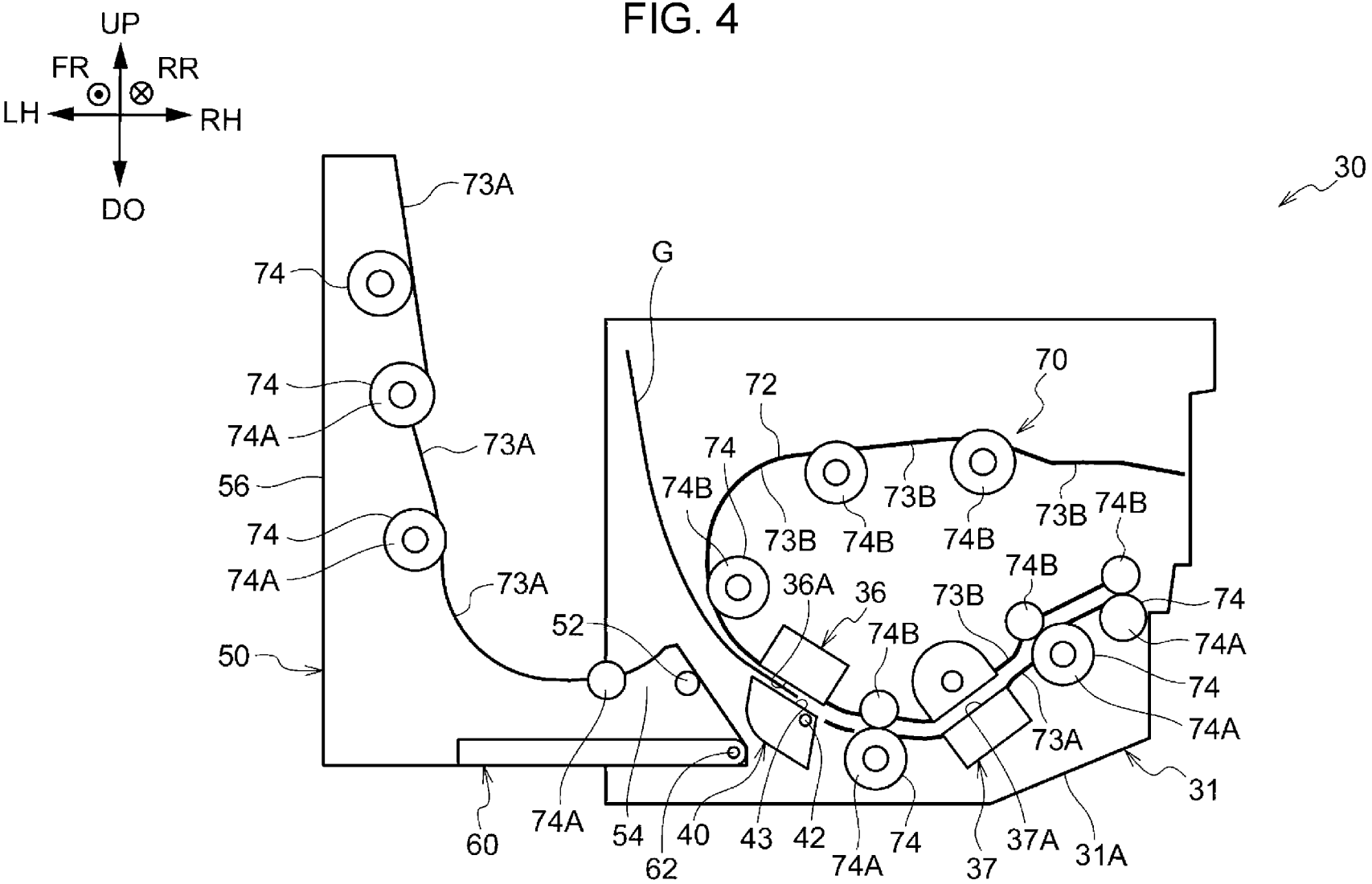
FIG. 4 is a schematic view of the document reading device in FIG. 3 with a first opening and closing covering part being open.

In the present exemplary embodiment, the first opening and closing covering part 50 supports the second opening and closing covering part 60 and is opened and closed with the second opening and closing covering part 60 in an integrated manner. Thus, as FIG. 4 illustrates, when the first opening and closing covering part 50 is rotated to the opening position, the second opening and closing covering part 60 is also opened relative to the document reading device body 31.

The first opening and closing covering part 50 further has the transport roller 74A and the transport path surface 73A and is opened and closed with the transport roller 74A and the transport path surface 73A in an integrated manner. Thus, as FIG. 4 illustrates, when the first opening and closing covering part 50 is rotated to the opening position, the transport roller 74A and the transport path surface 73A are separated from the transport roller 74B and the transport path surface 73B to expose the transport path surface 73A, and a contact state (that is, a nip state) of a pair of the transport rollers 74A and 74B is released. In this way, the document transport path 72 is opened. That is, the first opening and closing covering part 50 opens, at the opening position, the document transport path 72.

For example, when a jam of a document G is caused in the document transport path 72, the first opening and closing covering part 50 is rotated to the opening position for the purpose of removing the jammed document G from the document transport path 72. Thus, the first opening and closing covering part 50 is an opening and closing covering part specifically for unjamming.

In the present exemplary embodiment, the covering part body 54 is disposed beside (specifically, on the left side relative to) the reading unit covering part 40. Thus, when the first opening and closing covering part 50 is rotated to the opening position, the reading unit covering part 40 is exposed. In the present exemplary embodiment, the rotating shaft 52 of the first opening and closing covering part 50 is disposed on the upper side relative to the rotating shaft 42 of the reading unit covering part 40. Thus, the amount by which the reading unit covering part 40 is exposed is small compared with when the rotating shaft 52 is disposed on the lower side relative to the rotating shaft 42.

(Second Opening and Closing Covering Part 60)

The second opening and closing covering part 60 in FIG. 2 and FIG. 3 is an example of a second opening and closing part. The second opening and closing covering part 60 is provided beside the document reading device body 31 so as to be opened and closed and exposes, at an opening position, the reading unit covering part 40.

As FIG. 3 illustrates, the second opening and closing covering part 60 extends along the covering part body 54 of the first opening and closing covering part 50 (that is, in the up-and-down direction). Specifically, the second opening and closing covering part 60 positioned in a left side part of the covering part body 54 extends upward from a lower part of the covering part body 54. In the up-and-down direction, the dimension of the second opening and closing covering part 60 is smaller than the dimension of the first opening and closing covering part 50.

The second opening and closing covering part 60, with the covering part body 54, constitutes the side part of the document reading device 30, and a side surface (specifically, the left side surface) of the second opening and closing covering part 60, with a side surface (specifically, the left side surface) of the covering part body 54, constitutes a side surface (specifically, the left side surface) of the document reading device 30. In the present exemplary embodiment, the second opening and closing covering part 60 is disposed beside (specifically, on the left side relative to) the reading unit 36 and the reading unit covering part 40.

Moreover, the second opening and closing covering part 60 has a rotating shaft 62 provided in a lower part and is supported by the first opening and closing covering part 50 so as to be opened and closed around the rotating shaft 62. Specifically, the rotating shaft 62 is provided, in the covering part body 54, in a part on the lower side and on the left side.

In addition, the rotating shaft 62 is positioned at a height lower than or equal to the height of the upper end of the reading surface 36A of the reading unit 36. The rotating shaft 62 is also positioned at a height lower than or equal to the height of the rotating shaft 42 of the reading unit covering part 40. Moreover, the rotating shaft 62 is positioned at a height lower than or equal to the height of the rotating shaft 52 of the first opening and closing covering part 50.

Figure 5:
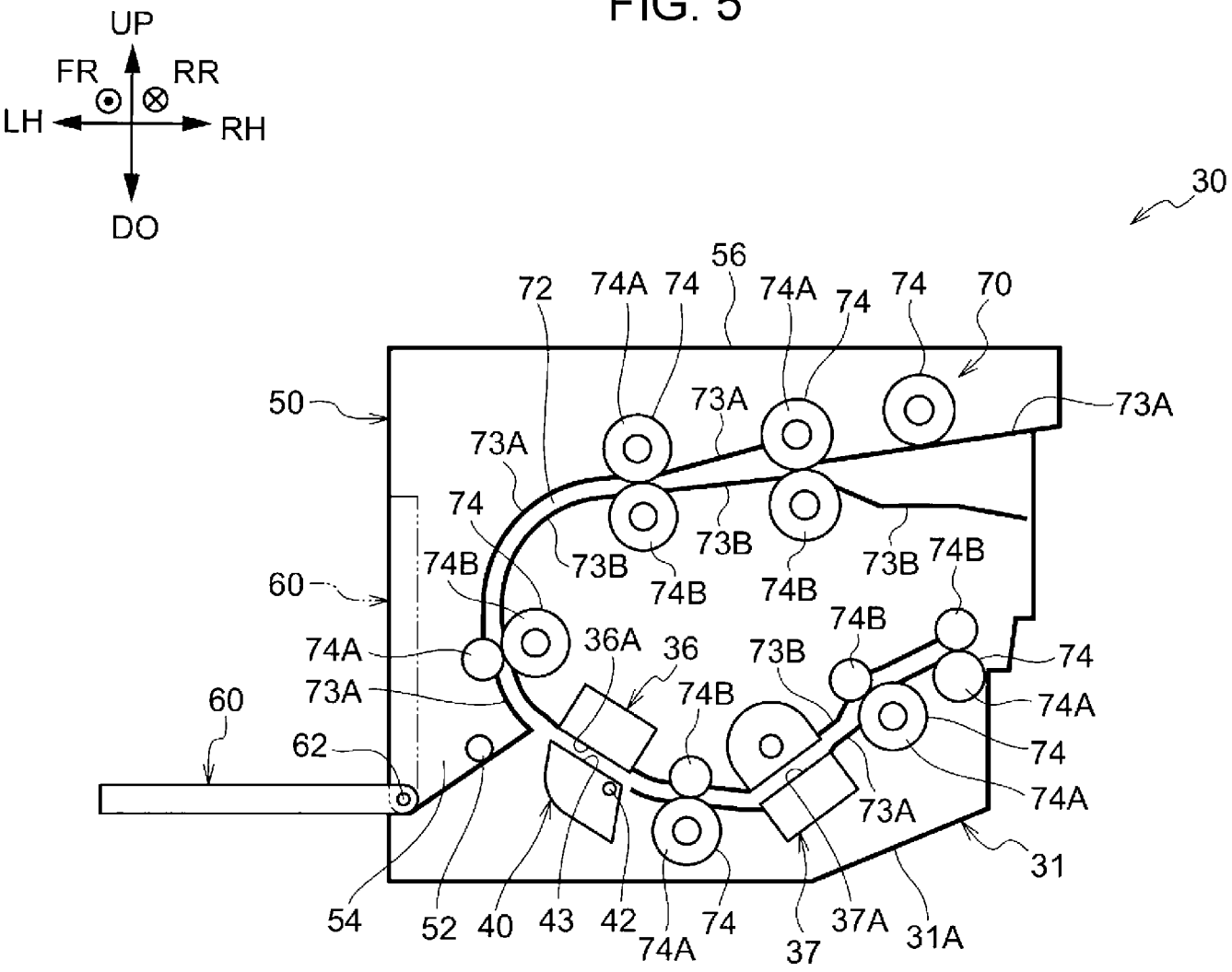
FIG. 5 is a schematic view of the document reading device in FIG. 3 with a second opening and closing covering part being open.

The second opening and closing covering part 60 is opened and closed between an opening position (represented by the solid line in FIG. 5) and a closing position (represented by the chain double-dashed line in FIG. 5) by the upper part thereof being rotated about the rotating shaft 62. Specifically, as FIG. 5 illustrates, the second opening and closing covering part 60 is rotated from the closing position to the opening position by being inclined leftward, from the closing position, at approximately 90 degrees. Note that the opening position is a position at which the second opening and closing covering part 60 is opened relative to the document reading device body 31, and the closing position is a position at which the second opening and closing covering part 60 is closed relative to the document reading device body 31.

In the present exemplary embodiment, the second opening and closing covering part 60 is disposed beside (specifically, on the left side relative to) the reading unit covering part 40. Thus, when the second opening and closing covering part 60 is rotated to the opening position, the reading unit covering part 40 is exposed.

For example, when the reading surface 36A of the reading unit 36 is cleaned, as FIG. 5 illustrates, the second opening and closing covering part 60 exposes the reading unit covering part 40 by being rotated to the opening position. After that, as FIG. 6 illustrates, the reading unit covering part 40 is rotated to the exposing position, and the reading surface 36A is cleaned. Thus, the second opening and closing covering part 60 is an opening and closing covering part specifically for cleaning the reading surface 36A of the reading unit 36.

Note that, unlike the first opening and closing covering part 50, the second opening and closing covering part 60 is not provided with transport rollers 74A and 74B and transport path surfaces 73A and 73B. Thus, even when the second opening and closing covering part 60 is rotated to the opening position, the document transport path 72 is not opened.

(Actions According to Present Exemplary Embodiment)

As described above, the document reading device 30 has: the first opening and closing covering part 50 that is provided on the document reading device body 31 so as to be opened and closed and opens, at the opening position, the document transport path 72; and the second opening and closing covering part 60 that is provided beside the document reading device body 31 so as to be opened and closed and exposes, at the opening position, the reading unit covering part 40.

Thus, when a jam is caused in the document transport path 72, as FIG. 4 illustrates, it is possible to remove the jammed document G from the document transport path 72 by the first opening and closing covering part 50 being rotated to the opening position.

On the other hand, when the reading surface 36A of the reading unit 36 is cleaned, as FIG. 5 illustrates, the second opening and closing covering part 60 exposes the reading unit covering part 40 by being rotated to the opening position. After that, as FIG. 6 illustrates, the reading unit covering part 40 is rotated to the exposing position, and it is then possible to clean the reading surface 36A.

Figure 7:
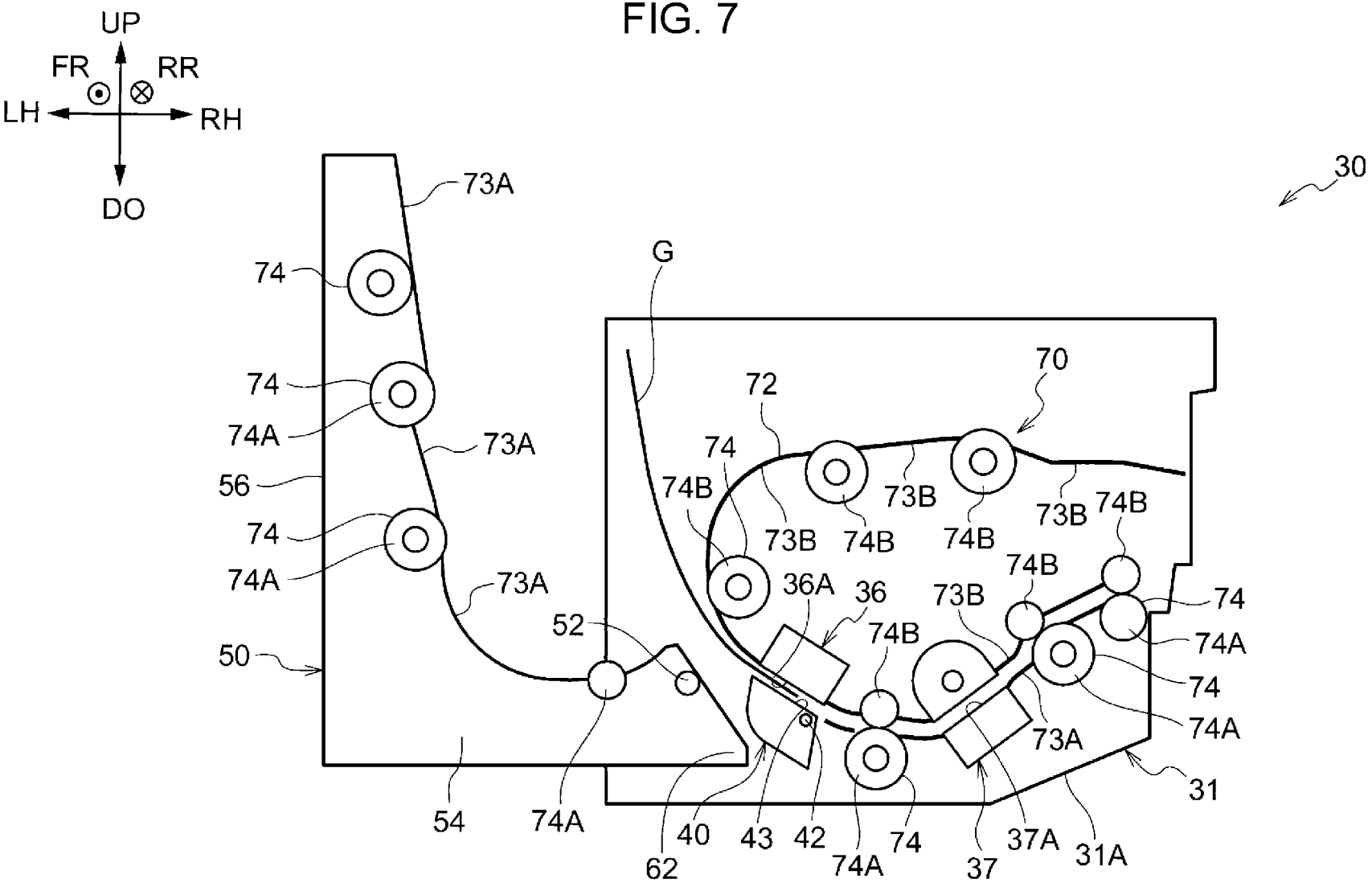
FIG. 7 is a schematic view of a document reading device according to a comparative example.
Figure 8:
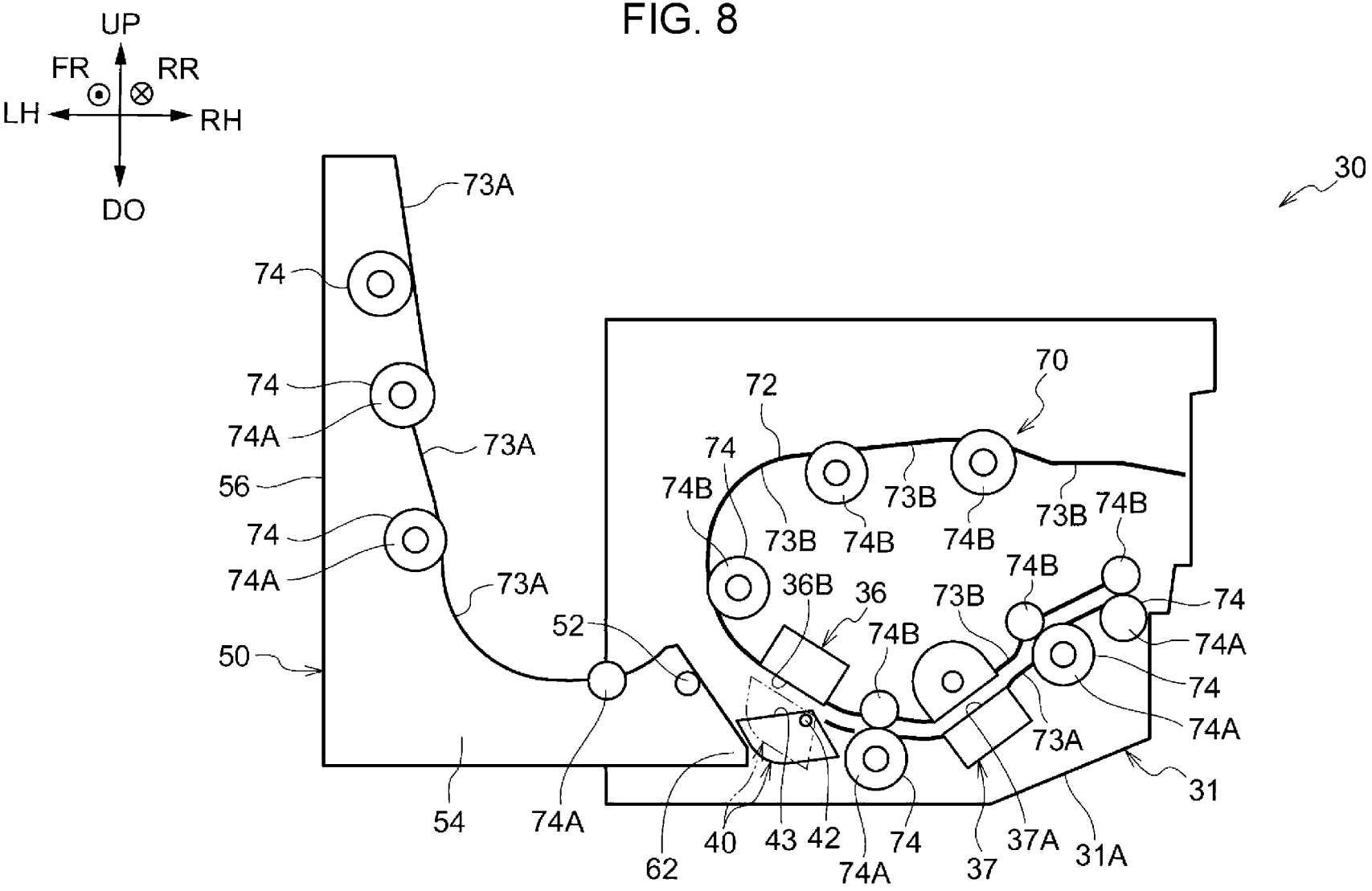
FIG. 8 is a schematic view of the document reading device in FIG. 7 with a reading unit covering part being open.

Here, as FIG. 7 and FIG. 8 illustrate, in a form (hereinafter, referred to as Form A) in which the reading unit covering part 40 is exposed only by the first opening and closing covering part 50 being opened without the second opening and closing covering part 60 being provided, the first opening and closing covering part 50 is required to be opened in both instances of a jam caused in the document transport path 72 and the cleaning of the reading surface 36A of the reading unit 36.

That is, when a jam is caused in the document transport path 72, as FIG. 7 illustrates, the jammed document G is removed from the document transport path 72 by the first opening and closing covering part 50 being rotated to the opening position. On the other hand, when the reading surface 36A of the reading unit 36 is cleaned, as FIG. 8 illustrates, the reading unit covering part 40 is exposed by the first opening and closing covering part 50 being rotated to the opening position, the reading unit covering part 40 is subsequently rotated to the exposing position, and the reading surface 36A is cleaned.

As described above, because there is no need to move the reading unit covering part 40 when a jam is caused in the document transport path 72, the first opening and closing covering part 50 may be closed with the reading unit covering part 40 remaining at the exposing position, when the cleaning operation is confused with the operation for jam during the cleaning of the reading surface 36A of the reading unit 36.

In contrast, in the present exemplary embodiment, the first opening and closing covering part 50 is opened and closed when a jam is caused in the document transport path 72, and the second opening and closing covering part 60 is opened and closed when the reading surface 36A of the reading unit 36 is cleaned. In such a way, it is possible to use different opening and closing covers for different operations. Thus, according to the present exemplary embodiment, the second opening and closing covering part 60 may be suppressed from being closed with the reading unit covering part 40 remaining at the exposing position, compared with Form A. As a result, compared with Form A, an image defect due to a failure in reading an image of a document G may be suppressed from being caused.

In addition, in the present exemplary embodiment, the second opening and closing covering part 60 is opened and closed by the upper part thereof being rotated about the rotating shaft 62 provided in the lower part of the second opening and closing covering part 60.

Thus, the reading unit covering part 40 may be easily accessible from a position beside the document reading device body 31 and on the upper side relative to the reading unit covering part 40, compared with when the second opening and closing covering part 60 is opened and closed by the lower part thereof being rotated about the rotating shaft 62 provided in the upper part of the second opening and closing covering part 60.

In addition, in the present exemplary embodiment, the rotating shaft 62 of the second opening and closing covering part 60 is positioned at a height lower than or equal to the height of the upper end of the reading surface 36A of the reading unit 36.

Thus, the reading unit covering part 40 may be easily exposed, compared with when the rotating shaft 62 of the second opening and closing covering part 60 is positioned at a height higher than the height of the upper end of the reading surface 36A of the reading unit 36.

In addition, in the present exemplary embodiment, the rotating shaft 62 of the second opening and closing covering part 60 is positioned at a height lower than or equal to the height of the rotating shaft 42 of the reading unit covering part 40.

Thus, the reading unit covering part 40 may be easily exposed, compared with when the rotating shaft 62 of the second opening and closing covering part 60 is positioned at a height higher than the height of the rotating shaft 42 of the reading unit covering part 40.

In addition, in the present exemplary embodiment, the rotating shaft 62 of the second opening and closing covering part 60 is positioned at a height lower than or equal to the height of the rotating shaft 52 of the first opening and closing covering part 50.

Thus, the reading unit covering part 40 may be easily exposed, compared with when the rotating shaft 62 of the second opening and closing covering part 60 is positioned at a height higher than the height of the rotating shaft 52 of the first opening and closing covering part 50.

In addition, in the present exemplary embodiment, the first opening and closing covering part 50 is opened and closed with the second opening and closing covering part 60 in an integrated manner.

Thus, the document transport path 72 may be easily opened, compared with when the first opening and closing covering part 50 is opened and closed independently from the second opening and closing covering part 60.

In the present exemplary embodiment, the second opening and closing covering part 60 is supported by the first opening and closing covering part 50. Thus, the document reading device body 31 may be easily opened, compared with when the second opening and closing covering part 60 is supported by the document reading device body 31 so as to be opened and closed.

In the present exemplary embodiment, in the up-and-down direction, the dimension of the second opening and closing covering part 60 is smaller than the dimension of the first opening and closing covering part 50.

Thus, the size of the second opening and closing covering part 60 may be reduced, compared with when, in the up-and-down direction, the dimension of the second opening and closing covering part 60 is larger than the dimension of the first opening and closing covering part 50.

In addition, in the present exemplary embodiment, as FIG. 1 illustrates, the document reading device body 31 is disposed on the upper side relative to and fixed relative to the image forming apparatus body 11.

Thus, while the apparatus configuration of the image forming apparatus 10 is maintained simple, the second opening and closing covering part 60 may be suppressed from being closed with the reading unit covering part 40 remaining at the exposing position, compared with when the document reading device body 31 is disposed on the upper side relative to and opened and closed relative to the image forming apparatus body 11.

(Modification of Reading Unit Covering Part 40)

In the present exemplary embodiment, by being rotated around the rotating shaft 42, the reading unit covering part 40 is moved between the covering position (represented by the chain double-dashed line in FIG. 6) and the exposing position (represented by the solid line in FIG. 6). However, the configuration is not the only option. The reading unit covering part 40 may perform, for example, a linear movement such as sliding between the covering position and the exposing position and may be any constituting element capable of being moved to the covering position and to the exposing position.

(Modification of First Opening and Closing Covering Part 50)

Although, in the present exemplary embodiment, the first opening and closing covering part 50 is opened and closed with the second opening and closing covering part 60 in an integrated manner, the configuration is not the only option. For example, the first opening and closing covering part 50 may be opened and closed independently from the second opening and closing covering part 60 and may be any constituting element that opens, at the opening position, the document transport path 72.

(Modification of Second Opening and Closing Covering Part 60)

Although, in the present exemplary embodiment, the second opening and closing covering part 60 is opened and closed by the upper part thereof being rotated about the rotating shaft 62 provided in the lower part of the second opening and closing covering part 60, the configuration is not the only option. The second opening and closing covering part 60 may be opened and closed, for example, by the lower part thereof being rotated about the rotating shaft 62 provided in the upper part of the second opening and closing covering part 60 and may be any constituting element that exposes, at the opening position, the reading unit covering part 40.

In addition, although, in the present exemplary embodiment, the rotating shaft 62 of the second opening and closing covering part 60 is positioned at a height lower than or equal to the height of the upper end of the reading surface 36A of the reading unit 36, the configuration is not the only option. For example, the rotating shaft 62 of the second opening and closing covering part 60 may be positioned at a height higher than the height of the upper end of the reading surface 36A of the reading unit 36.

In addition, although, in the present exemplary embodiment, the rotating shaft 62 of the second opening and closing covering part 60 is positioned at a height lower than or equal to the height of the rotating shaft 42 of the reading unit covering part 40, the configuration is not the only option. For example, the rotating shaft 62 of the second opening and closing covering part 60 may be positioned at a height higher than the height of the rotating shaft 42 of the reading unit covering part 40.

In addition, although, in the present exemplary embodiment, the rotating shaft 62 of the second opening and closing covering part 60 is positioned at a height lower than or equal to the height of the rotating shaft 52 of the first opening and closing covering part 50, the configuration is not the only option. For example, the rotating shaft 62 of the second opening and closing covering part 60 may be positioned at a height higher than the height of the rotating shaft 52 of the first opening and closing covering part 50.

Although, in the present exemplary embodiment, the second opening and closing covering part 60 is supported by the first opening and closing covering part 50, the configuration is not the only option. For example, the second opening and closing covering part 60 may be supported by the document reading device body 31 so as to be opened and closed.

Although, in the present exemplary embodiment, in the up-and-down direction, the dimension of the second opening and closing covering part 60 is smaller than the dimension of the first opening and closing covering part 50, the configuration is not the only option. For example, in the up-and-down direction, the dimension of the second opening and closing covering part 60 may be larger than the dimension of the first opening and closing covering part 50.

In addition, although, in the present exemplary embodiment, the second opening and closing covering part 60 is provided beside the document reading device body 31 so as to be opened and closed, the configuration is not the only option. The second opening and closing covering part 60 may be provided beside the document reading device body 31 so as to be removed from and mounted on the first opening and closing covering part 50 or the document reading device body 31. In such an instance, the second opening and closing covering part 60 exposes the reading unit covering part 40, at a removal position at which the second opening and closing covering part 60 is removed from the first opening and closing covering part 50 or the document reading device body 31.

(Modification of Document Reading Device Body 31)

Although, in the present exemplary embodiment, as FIG. 1 illustrates, the document reading device body 31 is disposed on the upper side relative to and fixed relative to the image forming apparatus body 11, the configuration is not the only option. For example, the document reading device body 31 may be disposed on the upper side relative to and opened and closed relative to the image forming apparatus body 11.

The present disclosure is not limited to the above-described exemplary embodiment, and various modifications, changes, and improvements may be made without departing from the spirit of the present disclosure. For example, plural ones of the above-described modifications may be appropriately combined.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

APPENDIX (((1)))

A document reading device comprising:

a device body;

a transport path that is provided in the device body and through which a document is transported;

a reading unit that is provided in the device body, has a reading surface, and reads an image of a document transported through the transport path;

a moving part that is provided in the device body and is capable of being moved to a covering position at which the moving part covers the reading surface and to an exposing position at which the moving part exposes the reading surface;

a first opening and closing part that is provided on the device body so as to be opened and closed and opens the transport path, at a first opening position; and a second opening and closing part that is provided beside the device body so as to be opened and closed or so as to be removable and mountable and exposes the moving part, at a second opening position or a removal position.

(((2)))

The document reading device according to (((1))), wherein the second opening and closing part has a second rotating shaft provided in a lower part of the second opening and closing part and is opened and closed by an upper part of the second opening and closing part being rotated about the second rotating shaft.

(((3)))

The document reading device according to (((2))), wherein the second rotating shaft is positioned at a height lower than or equal to a height of an upper end of the reading surface.

(((4)))

The document reading device according to (((2))) or (((3))), wherein the moving part has a moving-part rotating shaft and is moved by being rotated about the moving-part rotating shaft, and wherein the second rotating shaft of the second opening and closing part is positioned at a height lower than or equal to a height of the moving-part rotating shaft of the moving part.

(((5)))

The document reading device according to any one of (((2))) to (((4))), wherein the first opening and closing part has a first rotating shaft provided in a lower part of the first opening and closing part and is opened and closed by an upper part of the first opening and closing part being rotated about the first rotating shaft, and wherein the second rotating shaft of the second opening and closing part is positioned at a height lower than or equal to a height of the first rotating shaft of the first opening and closing part.

(((6)))

The document reading device according to any one of (((1))) to (((5))), wherein the first opening and closing part is opened and closed with the second opening and closing part in an integrated manner.

(((7)))

The document reading device according to (((6))), wherein the second opening and closing part is supported by the first opening and closing part so as to be opened and closed or so as to be removable and mountable.

(((8)))

The document reading device according to any one of (((1))) to (((7))), wherein, in an up-and-down direction, a dimension of the second opening and closing part is smaller than a dimension of the first opening and closing part.

(((9)))

An image forming apparatus comprising:

the document reading device according to any one of (((1))) to (((8))); and an image forming section being capable of forming an image read by the document reading device, on a recording medium.

(((10)))

The image forming apparatus according to (((9))), further comprising:

an image forming apparatus body in which the image forming section is provided, wherein the device body of the document reading device is disposed on an upper side relative to and fixed relative to the image forming apparatus body.

What is claimed is:

1. A document reading device comprising:

a device body;

a transport path that is provided in the device body and through which a document is transported;

a reading unit that is provided in the device body, has a reading surface, and reads an image of the document transported through the transport path;

a moving part that is provided in the device body and is capable of being moved to a covering position at which the moving part covers the reading surface and to an exposing position at which the moving part exposes the reading surface;

a first opening and closing part that is provided on the device body so as to be opened and closed and opens the transport path, at a first opening position; and a second opening and closing part that is provided beside the device body so as to be opened and closed or so as to be removable and mountable and exposes the moving part, at a second opening position or a removal position.

2. The document reading device according to claim 1, wherein the second opening and closing part has a second rotating shaft provided in a lower part of the second opening and closing part and is opened and closed by an upper part of the second opening and closing part being rotated about the second rotating shaft.

3. The document reading device according to claim 2, wherein the second rotating shaft is positioned at a height lower than or equal to a height of an upper end of the reading surface.

4. An image forming apparatus comprising:

the document reading device according to claim 3; and an image forming section being capable of forming an image read by the document reading device, on a recording medium.

5. The image forming apparatus according to claim 4, further comprising:

an image forming apparatus body in which the image forming section is provided, wherein the device body of the document reading device is disposed on an upper side relative to and fixed relative to the image forming apparatus body.

6. The document reading device according to claim 2, wherein the moving part has a moving-part rotating shaft and is moved by being rotated about the moving-part rotating shaft, and wherein the second rotating shaft of the second opening and closing part is positioned at a height lower than or equal to a height of the moving-part rotating shaft of the moving part.

7. An image forming apparatus comprising:

the document reading device according to claim 6; and an image forming section being capable of forming an image read by the document reading device, on a recording medium.

8. The image forming apparatus according to claim 7, further comprising:

an image forming apparatus body in which the image forming section is provided, wherein the device body of the document reading device is disposed on an upper side relative to and fixed relative to the image forming apparatus body.

9. The document reading device according to claim 2, wherein the first opening and closing part has a first rotating shaft provided in a lower part of the first opening and closing part and is opened and closed by an upper part of the first opening and closing part being rotated about the first rotating shaft, and wherein the second rotating shaft of the second opening and closing part is positioned at a height lower than or equal to a height of the first rotating shaft of the first opening and closing part.

10. An image forming apparatus comprising:

the document reading device according to claim 9; and an image forming section being capable of forming an image read by the document reading device, on a recording medium.

11. An image forming apparatus comprising:

the document reading device according to claim 2; and an image forming section being capable of forming an image read by the document reading device, on a recording medium.

12. The image forming apparatus according to claim 11, further comprising:

an image forming apparatus body in which the image forming section is provided, wherein the device body of the document reading device is disposed on an upper side relative to and fixed relative to the image forming apparatus body.

13. The document reading device according to claim 1, wherein the first opening and closing part is opened and closed with the second opening and closing part in an integrated manner.

14. The document reading device according to claim 13, wherein the second opening and closing part is supported by the first opening and closing part so as to be opened and closed or so as to be removable and mountable.

15. An image forming apparatus comprising:

the document reading device according to claim 14; and an image forming section being capable of forming an image read by the document reading device, on a recording medium.

16. An image forming apparatus comprising:

the document reading device according to claim 13; and an image forming section being capable of forming an image read by the document reading device, on a recording medium.

17. The document reading device according to claim 1, wherein, in an up-and-down direction, a dimension of the second opening and closing part is smaller than a dimension of the first opening and closing part.

18. An image forming apparatus comprising:

the document reading device according to claim 17; and an image forming section being capable of forming an image read by the document reading device, on a recording medium.

19. An image forming apparatus comprising:

the document reading device according to claim 1; and an image forming section being capable of forming an image read by the document reading device, on a recording medium.

20. The image forming apparatus according to claim 19, further comprising:

an image forming apparatus body in which the image forming section is provided, wherein the device body of the document reading device is disposed on an upper side relative to and fixed relative to the image forming apparatus body.

* * * * *